US005678624A

United States Patent [19]

Sakurai

[11] Patent Number: 5,678,624

[45] Date of Patent: Oct. 21, 1997

[54] INVESTMENT CASTING PROCESS

[75] Inventor: Junichi Sakurai, Tokyo, Japan

[73] Assignee: Sakurai Art Casting, Ltd., Tokyo, Japan

[21] Appl. No.: 538,246

[22] Filed: Oct. 3, 1995

[30] Foreign Application Priority Data

Oct. 7, 1994 [JP] Japan ..... 6-268072

[51] Int. Cl.[6] ..... B22C 9/04; B22C 9/08

[52] U.S. Cl. ..... 164/519; 164/35; 164/36; 164/516

[58] Field of Search ..... 164/516, 34, 35, 164/36, 45, 519

[56] References Cited

U.S. PATENT DOCUMENTS

| | | | |
|---|---|---|---|
| 3,094,751 | 6/1963 | Horton | 164/36 |
| 3,186,041 | 6/1965 | Horton | 164/36 X |
| 3,206,810 | 9/1965 | Hockin et al. | 164/519 |
| 3,263,286 | 8/1966 | Watts et al. | 164/45 X |
| 4,809,761 | 3/1989 | Nankee et al. | 164/36 X |
| 4,812,278 | 3/1989 | Natori et al. | 164/36 X |

FOREIGN PATENT DOCUMENTS

| | | | |
|---|---|---|---|
| 59-163049 | 9/1984 | Japan | 164/35 |
| 60-124439 | 7/1985 | Japan | 164/518 |
| 1-289537 | 11/1989 | Japan | 164/36 |
| 4-200952 | 7/1992 | Japan | 164/35 |
| 4-200953 | 7/1992 | Japan | 164/35 |

*Primary Examiner*—J. Reed Batten, Jr.

*Attorney, Agent, or Firm*—Frishauf, Holtz, Goodman, Langer & Chick, P.C.

[57] ABSTRACT

An investment casting process which includes: attaching a gate to a pattern made of a plastic to form a pattern assembly; forming a mold by applying a plaster slurry on an outer surface of the pattern assembly; dissolving and removing the pattern assembly in the mold by applying an organic solvent; burning the mold from which the pattern has been removed; casting by pouring a molten metal into the burned mold; and breaking the mold to take out a cast product.

9 Claims, 1 Drawing Sheet

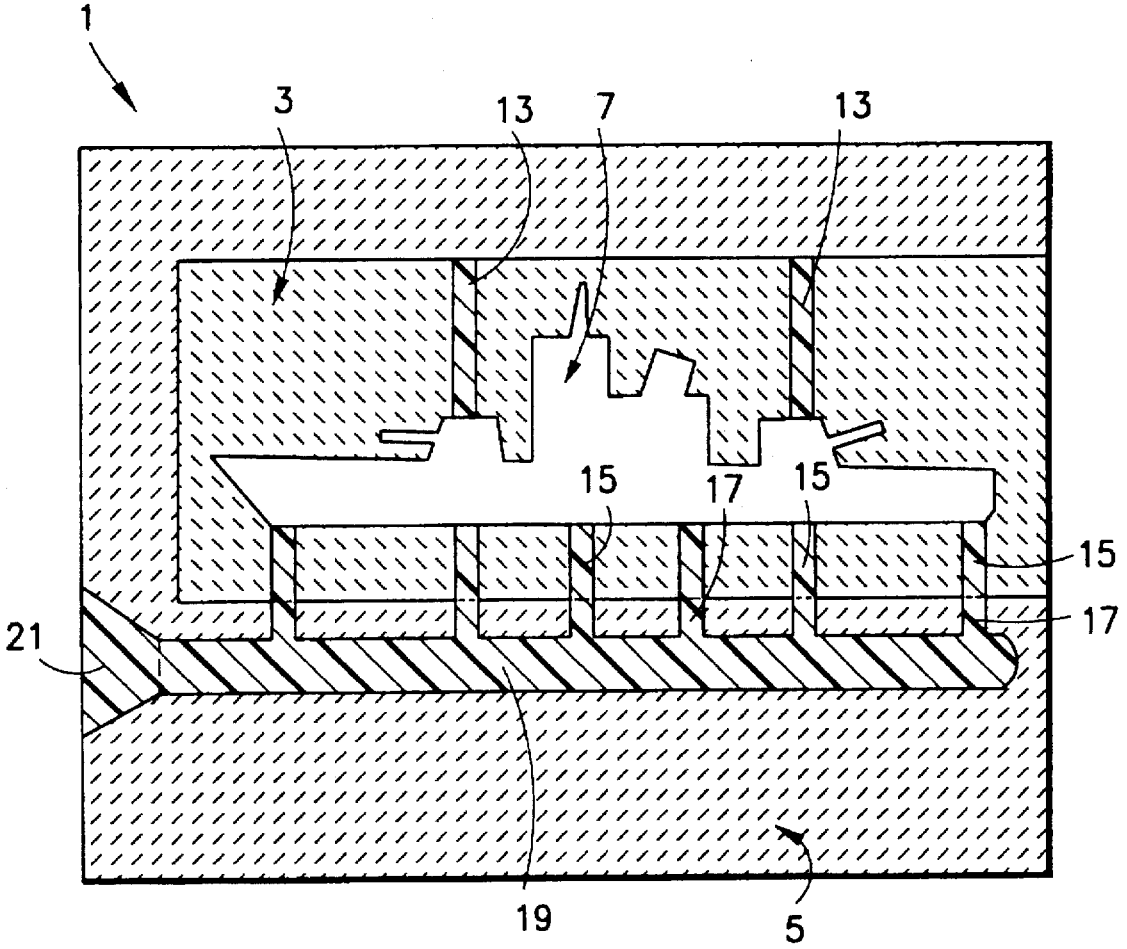
1
3
13
7
13
15
17
15
15
17
21
19
5

INVESTMENT CASTING PROCESS

BACKGROUND OF THE INVENTION

1. Field of the Invention

This invention relates to an investment casting process similar to a lost wax process (an investment process). Particularly, the present invention relates to an investment casting process which can desirably duplicate a model shape with fine and precision by using a model made of a hard plastic, such as a hard vinyl chloride, etc.

2. Prior Art

In the lost wax process, as is well known in the art, after forming a mold around a wax pattern, the temperature of the mold is elevated to melt away the wax from the mold to obtain a casting space (a cavity).

Among the conventional casting processes, the lost wax process using a wax pattern is the most desirable method to duplicate a fine shape and design. However, even when the lost wax process is used, there is a limit to duplicate a shape at a thin rod-like portion or a sharp edge portion.

SUMMARY OF THE INVENTION

An object of the present invention is to provide an investment casting process which can desirably duplicate a shape even at a thin rod-like portion or a sharp edge portion.

In order to solve the above problem, the investment casting process of the present invention comprises the steps of an assembly step of attaching a gate, runner, sprue, etc., to a pattern made of a hard plastic; a molding step of forming a mold comprising a plaster mix for a mold and/or a ceramics slurry on the surface of the resulting pattern assembly; a pattern dissolving step of dissolving and removing the pattern assembly in the mold by using an organic solvent; a burning step of burning the mold from which the pattern assembly has been removed; a casting step of pouring a molten metal in the burned mold; and a mold breaking step of breaking the mold to take out a cast product.

BRIEF DESCRIPTION OF THE DRAWINGS

The figure is a schematic drawing showing a structure of a mold to be used in the investment casting process according to one example of the present invention.

DESCRIPTION OF THE PREFERRED EMBODIMENTS

The investment casting process of the present invention uses a pattern made of a hard plastic as a prototype. Thus, as compared with the conventional wax pattern, in the present invention, the strength of the pattern is high and the possibility of deformation or breakage of the pattern is small so that even at a portion such as a thin rod-like portion, etc., the pattern is scarcely deformed during a molding step. Therefore, the ability to duplicate a product having such a complicated portion is excellent.

The hard plastic to be used in the present invention includes a hard vinyl chloride (a polyvinyl chloride or a vinyl chloride-vinyl acetate copolymer), a polyethylene, a polypropylene, a styrol resin, etc., which are all thermoplastic resins.

As a material to be used for a gate, runner, sprue, etc., a hard plastic which is the same material for the pattern as mentioned above, or a wax for the lost wax process, or the like may be used. At the time of pattern removal step, the former is removed by dissolving using an organic solvent and the latter is melted away. When the gate, etc. are adhered to a pattern, various kinds of an adhesive are used or a hot melt using a melt adhesive is carried out.

For molding, the same technique as in the lost wax process can basically be applied. However, a point to be noted is to select a slurry liquid suitably so that the slurry for investing (embedding) or for dipping does not react with a hard plastic pattern. Also, it is important that a pattern assembly is to be designed so that dissolution of the pattern can be easily carried out in the pattern dissolving step.

An organic solvent to be used in the pattern dissolving step can be selected from an organic solvent suitable for a material of the pattern. For example, for dissolving a plastic pattern made of a polyvinyl chloride type resin, methylene chloride, methyl ethyl ketone, tetrahydrofuran, amyl acetate, toluene, dimethylformamide, etc. may be used.

The temperature of the organic solvent to be used in the pattern dissolving step may be a normal temperature.

The subsequent burning step, casting step and mold breaking step are basically the same as those of the conventional lost wax process. A material for casting may be any metal, so long as the lost wax process can be applied, including ferrous, non-ferrous (copper, aluminum, zinc or tin), precious metal (gold or silver), alloys thereof, etc. Also, as the casting method, various casting methods such as centrifugal casting, vacuum casting, vacuum assist casting, pressure casting, etc. may be used.

An investment casting process which is another embodiment of the present invention comprises the steps of a primary pattern assembly step of attaching a gate, etc., to a pattern made of a hard plastic; a primary molding step of forming a primary mold comprising plaster for a mold and/or a ceramics slurry on the surface of the resulting primary pattern assembly; a pattern dissolving step of dissolving and removing the pattern assembly in the primary mold by using an organic solvent; a secondary pattern assembly step of attaching a gate, runner, etc., which are made of a wax, to the primary mold from which the primary pattern assembly has been removed; a secondary molding step of forming a secondary mold comprising plaster for a mold and/or a ceramics slurry on the surface of the resulting secondary pattern assembly; a melting away step of melting the gate, runner, etc., in the secondary mold; a burning step of burning the mold from which the runner, sprue, etc., have been removed; a casting step of pouring a molten metal in the burned mold; and a mold breaking step of breaking the mold to take out a cast product.

In the investment casting process of the present invention, it is important to completely remove the pattern made of a hard plastic by dissolving during the pattern dissolving step. It is also important that the processing time of the pattern dissolving step is shortened to improve production efficiency. Therefore, it is essential to minimize the amount of the pattern assembly to be removed by dissolution. It is also necessary to suitably arrange the position of the gates, which become dissolution outlets, or other dissolution outlets which are not gates for only promoting dissolution. On the other hand, when considering workability of the casting or the quality of a casting, it may be necessary to provide a runner or a sprue with a certain volume.

Thus, in the primary pattern assembly step, a minimum number of gates or dissolution outlets, etc. necessary for dissolving out the plastic are attached to the pattern, and after preparing a primary mold by using the primary pattern assembly as a prototype, a necessary runner or sprue of a wax is attached to the primary mold to prepare a secondary pattern assembly. By using the secondary pattern assembly, a secondary mold, which is the final mold, is prepared and a large-sized and thick gate or runner is melted away by elevating the temperature of the mold. By making the mold preparation step into two steps as mentioned above, a relatively large-sized and complicated pattern can be completely dissolved and removed within a relatively short period of time.

In the present invention, the above-mentioned pattern made of a hard plastic can be a so-called "PLAMODEL" (trade name, plastic model) made of a polyvinyl chloride type plastic. For example, by using a PLAMODEL of a warship as a prototype, an integral and precise casting product made of a precious metal can be produced. Such an artistic casting product provides an extremely preferred precision casting product to satisfy a lover of precise models.

EXAMPLES

In the following, examples of the present invention are set forth.

A process for producing a warship model made of a pure gold using a PLAMODEL of a warship as a prototype is explained on the basis of the two-step investing method using plaster for a mold.

(1) Preparation of a Model

A commercially available warship plastic model made of polyvinyl chloride was purchased and assembled to make a prototype. At this time, the bottom of the warship plastic model was detached and an excessively thick portion was cut down from the back side of the plastic model.

(2) Attachment of Gate, etc. (Primary Pattern Assembly)

A gate and a dissolution outlet prepared by a polyvinyl chloride were adhered to the plastic model with an adhesive. For selecting the position of attaching the gate, the same consideration was made as in the general lost wax process and also it was desired that the dissolution of the pattern be smooth. More specifically, it is important that, at the time of dissolution, convection of an organic solvent in the mold is easily generated. Also, it is recommendable to suitably provide a dissolution outlet, which does not serve as a gate.

The figure is a schematic view showing a structure of a mold to be used in the investment casting process according to one example of the present invention.

A mold 1 is constituted of a primary mold 3 which is to be prepared by the primary step, and a secondary mold 5 which is to be prepared by the secondary step.

A plastic model 7 of the warship is dissolved and removed after embedding in the primary mold 3. A runner 19 and a sprue 21 are formed in the secondary mold 5.

In the primary pattern assembly step, to the plastic model 7 in the figure are attached dissolution outlets 13, which are elongated upward from the ceiling portion of a gun turret of the warship 7, and gates 15, which serve also as dissolution outlets and are extended downward from the bottom of the warship 7. The position of the dissolution outlet 13 is preferably selected from the positions so as to easily repair the surface of the product afterward.

(3) Preparation of Slurry for Embedding

Water was added to plaster for a lost wax investment (available from R & R Co., trade name: Ultrabest) to prepare a slurry for embedding. The slurry was stirred and defoamed under reduced pressure.

(4) Pattern Investing

The pattern is put in a vessel to invest the model by the slurry. Thereafter, the whole material is defoamed under reduced pressure.

(5) Mold Hardening

The material is held at room temperature to harden the slurry whereby a mold is hardened.

(6) Dissolution and Removal of Primary Pattern Assembly

The mold is dipped in an organic solvent (methylene chloride) at room temperature, and the pattern is dissolved and removed. At this time, a posture of the mold is optionally selected and configuration of the dissolution outlets (a park thereof also serves as a gate) is considered so as to easily permit circulation of the organic solvent. The time required for removing a thin rod portion of the model having a diameter of 0.5 mm and a length of 5 mm by dissolution is one and a half days. Whether a residue of the pattern after removal by dissolution remains or not can be confirmed by putting the mold in a fresh organic solvent and checking whether any turbidity of the added solvent due to dissolution of the plastic is observed or not at the dissolution outlet portion. By the above procedure, preparation of the primary mold (reference numeral 3 in the figure) is completed.

(7) Attachment of secondary gate, runner, etc. (Secondary pattern assembly step)

Explanation is made by referring to FIG. 1 again.

Referring again to the figure, secondary gates 17 are provided with a shape so as to elongate the primary gates 15. More specifically, a rod of a wax (e.g., a diameter of 3 mm) is attached by thrusting it in a hole of the primary gate 15 in the state that the head thereof is exposed with a length of 5 mm or so. Next, a runner 19 made of a wax is attached to the end of the secondary gates 17. Further, to the left end of the runner 19, a sprue 21 is attached. Incidentally, the dissolution outlet 13 which does not become a gate at the time of casting is filled-up with wax. By the above procedure, the secondary pattern assembly is completed.

(8) Secondary Investment (Secondary Molding Step)

The secondary pattern assembly was invested in a slurry in a flask. Preparation of the slurry and the stirring and defoaming treatment are the same as those of the model investing treatment.

(9) Dewaxing and Mold Burning

Under atmospheric environment, dewaxing was carried out at 220° C., and then the temperature was gradually elevated and burning was carried out at 500° C. to 800° C.

(10) Casting

Pure gold was cast by vacuum assist casting at a mold temperature of 300° C. to 600° C. and a casting temperature of 1250° C.

(11) Mold Breaking

After casting, the mold was dipped into water and the mold was broken by blowing a pressurized water stream. Then, a finishing washing was carried out by an ultrasonic washing.

(12) Finishing

The runner, etc., were cut off and finishing at the bottom surface portion of the cast product (warship) or the gun turret portion were carried out by a file. Further, correction of bending at the fine diameter rod portion was carried out.

In the product produced by the above procedure, the model can be faithfully reproduced even at the rod portion having a diameter of 0.2 mm and a length of 3 mm or a fine projection with a width of about 0.1 mm.

As can be clearly seen from the above explanation, since the precise investment casting method of the present invention uses a pattern made of a hard plastic as a prototype, strength and hardness of the pattern (prototype) are high as compared to those of the conventional pattern made of a wax so that no deformation of the pattern occurs during a molding step, even when at a thin rod-like portion, etc.

Therefore, a precise investment casting method can be provided with a desirable capability of duplication even at a thin rod-like portion or a sharp edge portion.

What is claimed is:

1. An investment casting process which comprises the steps of:

(a) attaching a gate to a pattern made of a plastic to form a primary pattern assembly;

(b) forming a primary mold by applying a slurry of a plaster for a mold on the outer surface of the primary pattern assembly from step (a);

(c) dissolving and removing the primary pattern assembly in the primary mold by applying an organic solvent;

(d) attaching a runner which is made of a wax, to the primary mold from which the primary pattern assembly has been removed to form a secondary pattern assembly;

(e) forming a secondary mold on the surface of the secondary pattern assembly from step (d);

(f) melting the runner in the secondary mold;

(g) burning the mold from which the runner has been melted in step (f);

(h) casting by pouring a molten metal into the burned mold from step (g); and (i) breaking the mold to take out a cast product.

2. The investment casting process of claim 1, wherein the pattern made of a plastic is a plastic model made of a polyvinyl chloride resin.

3. The investment casting process of claim 1, wherein the pattern is made of a thermoplastic resin.

4. The investment casting process of claim 1, wherein the pattern is made of a plastic selected from the group consisting of vinyl chloride-vinyl acetate copolymer, polyethylene, polypropylene and a styrol resin.

5. The investment casting process of claim 1, wherein the metal is selected from the group consisting of copper, aluminum, zinc, tin, gold, silver and alloys thereof.

6. The investment casting process of claim 1, wherein after casting, the mold is broken by dipping into water and by applying a pressurized stream of water.

7. The investment casting process of claim 2, wherein the organic solvent is selected from the group consisting of methylene chloride, methyl ethyl ketone, tetrahydrofuran, amyl acetate, toluene and dimethylformamide.

8. The investment casting process of claim 7, wherein the metal is gold.

9. The investment casting process of claim 8, wherein the solvent is methylene chloride.

* * * * *